United States Patent [19]

Gotou et al.

[11] Patent Number: 4,850,718

[45] Date of Patent: Jul. 25, 1989

[54] BAG

[75] Inventors: Toyokichi Gotou, Souka; Masami Fujishiro, Tama, both of Japan

[73] Assignees: Newlong Machine Works, Ltd.; New Pack Company, Ltd., both of Tokyo, Japan

[21] Appl. No.: 183,313

[22] Filed: Apr. 5, 1988

Related U.S. Application Data

[63] Continuation of Ser. No. 11,513, Feb. 19, 1987, abandoned.

[30] Foreign Application Priority Data

Feb. 7, 1986 [JP] Japan ..... 61-16356[U]

[51] Int. Cl.[4] ..... B65D 33/06

[52] U.S. Cl. ..... 383/20; 156/277; 383/6; 383/119; 493/226; 493/264

[58] Field of Search ..... 383/6, 20, 119, 25; 493/226, 264, 327; 156/217, 227, 277

[56] References Cited

U.S. PATENT DOCUMENTS

| | | | |
|---|---|---|---|
| 1,432,150 | 10/1922 | Bertin | 383/20 |
| 1,974,457 | 9/1934 | Groh | 383/20 |
| 2,150,043 | 3/1939 | Stark | 383/20 |
| 2,469,536 | 5/1949 | Winesett | 383/20 |
| 3,021,767 | 2/1962 | Hamilton | 383/6 |
| 3,034,699 | 5/1962 | Steen | 383/20 |
| 3,152,750 | 10/1964 | Bryant | 383/20 |
| 3,565,327 | 2/1971 | Rodley | 383/20 |
| 4,450,580 | 5/1984 | Lindsay | 383/6 |

FOREIGN PATENT DOCUMENTS

| | | | |
|---|---|---|---|
| 27622 | 2/1976 | Japan . | |
| 1159515 | 7/1969 | United Kingdom | 383/20 |

*Primary Examiner*—Stephen P. Garbe

*Attorney, Agent, or Firm*—Lowe, Price, LeBlanc, Becker & Shur

[57] ABSTRACT

A paper bag is formed from a single sheet of paper by folding the same to produce a final generally rectangular bag or receptacle with an open end. The upper edge portion around the bag opening is folded in and glued to provide greater strength thereat. During the folding and glueing of this opening strength turned-in collar, two carrying handles are also glued in, one on each of the bag's largest sides. According to this invention, a corner portion at one end of the turned-in collar portion is cut out and enables glueing thereat to an inner surface rather than the typically smoother outer surface of the paper, thereby providing improved strength to the reinforced opening of the bag.

3 Claims, 1 Drawing Sheet

BAG

This application is a continuation of application Ser. No. 011,513, filed Feb. 6, 1987, now abandoned.

FIELD OF THE INVENTION

The present invention relates to an open bag made of paper material of which the upper edge part around the opening assumes a double wall structure.

BACKGROUND OF THE PRIOR ART

The upper edge part around the opening of a paper bag is susceptible to injury or breakage by forcible contact with articles as they are placed therein and taken out therefrom. One technique for reinforcing the upper edge part of the paper bag, by providing a turned in collar around the opening thereof which is folded inwardly to build the double wall structure, is disclosed in Japanese Pat. No. 27622/1976.

The outermost surface of the material formed into a conventional paper bag is often subjected to surface processing such as printing or the like and, therefore, the surface of the turned in collar is also subjected to the same processing. Thus, as a result, when a paper sheet that is formed into the paper bag is folded and assembled into the bag-shaped configuration, glueing effected between a glue placing portion and the printed surface portion of the turned in collar involves gluing between two printed surfaces and this has a reduced gluing strength. Accordingly, in the course of repeated usage of the conventional paper bag, peeling at such a portion of the bag tends to occur and breakage tends to occur and spread from that location on the bag. To obviate the foregoing problem it is desirable to locate any printing on the bag away from the surface of the turned in collar so as to increase glueing strength between the glue placing portion and the turned in collar. However, to accomplish this the printing has to be carried out in a complicated manner.

SUMMARY OF THE INVENTION

The present invention has been made with the foregoing problem in mind, and its principal object is to provide a bag which assures that a conventional printed paper sheet can be used without any necessity for particular processing to make a strong bag-shaped configuration.

Another object of the present invention is to provide a bag which assures that glueing is achieved with a high intensity of glueing strength at the position where the upper end of a glue placing portion is adhesively secured to a part of the upper edge of the opening of the bag.

Another object of the present invention is to provide a bag which requires no modification or change relative to the steps of producing bags, the exception being that the turned in collar portion of the sheet of material formed into the bag has a cutout at one end thereof.

To accomplish the above objects, there is proposed according to the present invention a bag having a turned in collar folded inwardly of the upper edge of the opening wherein it is provided with a glue placing portion along a free end of the one side wall, the glue placing portion being adhesively secured to the free end of the other side wall of the bag, characterized in that the turned in collar is truncated at the one free end thereof so that the upper end of the glue placing portion is glued directly to a part of the rear surface of the other side wall of the bag.

In another preferred embodiment the turned in collar is formed with a plurality of cutouts through which a hand-carrying cord extends.

Other objects, features and advantages of the present invention will become readily apparent from reading the following description in conjunction with the accompanying drawings.

DESCRIPTION OF THE PREFERRED EMBODIMENT

Figure 1:
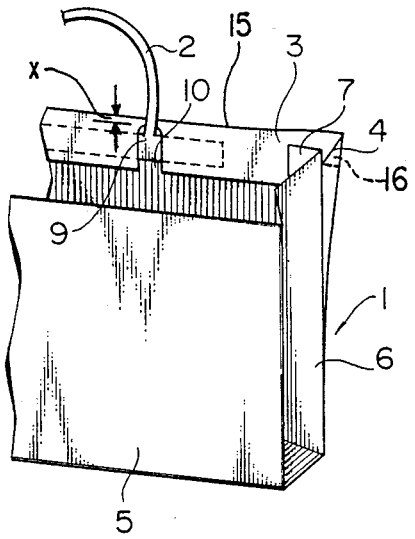
FIG. 1 is a fragmental perspective view of a paper bag in accordance with a preferred embodiment of the invention, particularly illustrating an essential part of the bag.

The present invention is described hereunder with reference to the accompanying drawings, which illustrate a preferred embodiment thereof.

A paper bag 1 includes one piece inverted and closed "U" shape hand-carrying cords disposed between a reinforcement paper 9 and each side wall of the paper bag 1 at the inside surface near the upper opening edge thereof. The upper rim extending along the periphery of the opening of the bag is folded inwardly to form a turned in collar 3 in the double wall structure. Further, the paper bag 1 includes a pair of side walls 5, 5*a* as seen in the direction of width and a pair of side walls 6 as seen in the direction of thickness.

Figure 2:
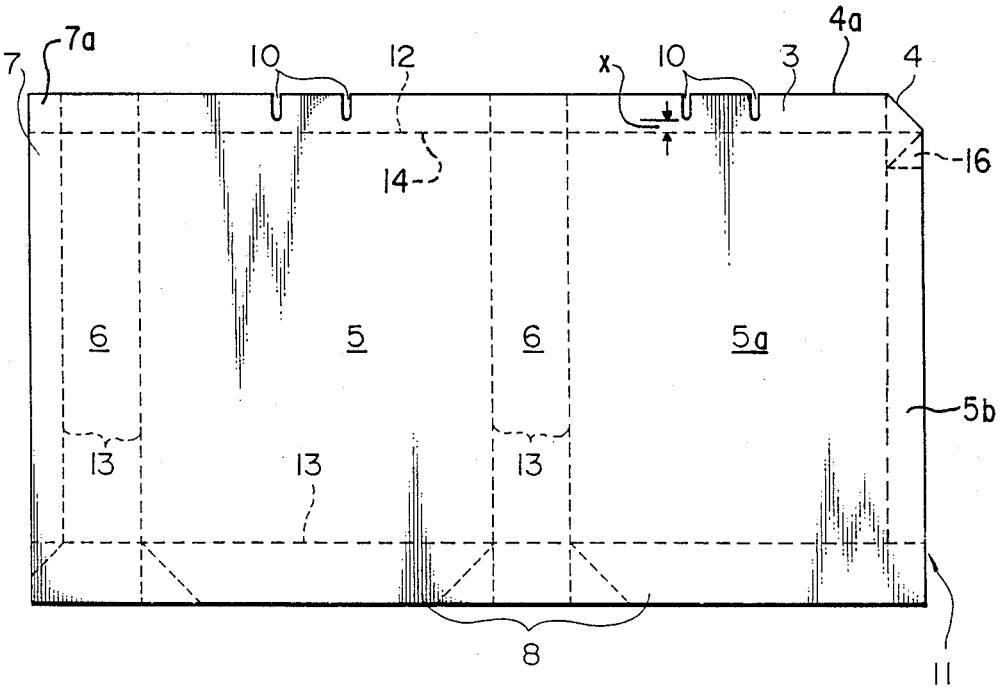
FIG. 2 is an expanded view of the paper bag of FIG. 1.

FIG. 2 is an expanded view of the paper bag as shown in FIG. 1. As is apparent from the drawing, a single paper sheet 11 which will constitute paper bag 1 has a turned in collar 3 along the upper edge part thereof foldable along a folding line 12. Turned in collar 3 is formed with four cutouts 10 through which a one-piece inverted and closed "U" shaped hand-carrying cord 2 (FIG. 1*a*) extends. The depth of each of the cutouts 10 is such that distance "x" (best seen in FIG. 2) is left between the bottom thereof and folding line 12; thereby the upper edge part of turned in collar 3 after the latter is folded in such a manner as illustrated in FIG. 1 assumes the double wall structure at the position where the cord 2 is to be located. Sheet 11 is then folded along the plurality of folding lines 13 to form side walls 5, 5*a* and 6 for the paper bag 1.

A glue placing portion 7, adapted to be adhesively secured to the corresponding part of the sheet 11, is provided at the left end part of the sheet 11 (FIG. 2) so as to allow it to assume an open bag-shaped configuration when folded and assembled.

Refering to FIG. 2 again, the right end of turned in collar 3 has a truncated cutout portion 4 corresponding the upper end part 7*a* of the glue placing portion 7 when the bag is formed by glueing.

Forming paper bag 1 with the use of the sheet 11 is achieved by way of the following steps:

First, turned in collar 3 is inwardly folded along the folding line 12. Next, folding operations are performed one after another along a plurality of vertically extending folding lines 13 on sheet 11 until the glue placing portion 7 located on side wall 6 contacts end corner 4*a* of side wall 5*a*. Glue means are then applied to reinforcement paper 9 and turned in collar 3, with hand-carrying cords 2 located therebetween and secured. Finally, glue means are applied to glue placing portion 7 to secure it to corresponding side wall 5*a* portion 5*b*.

When turned-in collar 3 is formed by inward folding thereof along line 14, best seen in FIG. 2, to define the upper edge 15 or rim of the bag opening (see FIG. 1), a triangular portion 16 of inner surface 5*b* is available for glueing. Had cutout 4 not been provided, then the upper corner of portion 5*b* would have been square and would have covered up now available inner surface portion 16. Now, when glueing is used to attach glueing portion 7 to the inside surface 5*b* of side wall 5, glue connects the printed or outside surface of folded-over glueing portion 7 to the triangular inner surface area of portion 16. This ensures a stronger glued bond all the way to the rim of the bag than would have resulted from printed surface-to-printed surface glueing at the junction of the collar portion and the top of portion 5*b*.

While the present invention has been made only with a single preferred embodiment, it should be understood that it should not be limited only to this embodiment but various changes or modifications may be made in any acceptable manner without departure from the spirit and scope of the invention as defined by the appended claims.

What is claimed is:

1. A bag, comprising:

a substantially rectangularly shaped sheet of material having a printed outer surface and an unprinted inner surface in relation to the bag to be formed therefrom, said sheet being formed to have folds defining wall panels and bottom portions of the bag;

first and second adjacent side wall panels connected at a seam to form a receptacle having an open upper end and a closed base end;

an upper rim portion of said receptacle, at said open upper end, folded inwardly of the receptacle to be glued to form a turned-in reinforcement collar with a rim at the open end, a side edge portion of said first side wall panel being coated with an adhesive to be secured to a side edge portion of said second side wall panel;

a corner of said collar at said side edge portion of said second side wall panel being cut out diagonally to form a triangular shaped truncated corner at said side edge portion of said second side wall panel to thereby enable said adhesive coated edge portion of said first side wall panel, after said collar has been formed, to be secured by adhesion between a non-printed surface and a printed surface at the collar portion of the receptacle to the end portion of said seam through said triangular shaped truncated corner of said collar to said second side wall panel.

2. The bag according to to claim 1, wherein:

said collar is formed to have two pairs of cutouts, one pair at each of two opposing sides of the bag, each cutout having an open end and a length shorter than said collar in a direction normal to the rim of the bag at its open end, for accommodating at each pair of the cutouts the respective ends of a carrying cord.

3. The bag according to claim 2, further comprising:

two cords, each disposed with its two ends located to extend within a corresponding one of said two pairs of cutouts and affixed to the bag at the collar, whereby each cord is secured to the reinforced collar of the bag for a user to hold the weight of the bag thereat.

* * * * *